United States Patent [19]

Okutsu

[11] Patent Number: 4,619,886

[45] Date of Patent: Oct. 28, 1986

[54] PROCESS FOR FORMING HIGH CONTRAST NEGATIVE IMAGE

[75] Inventor: Eiichi Okutsu, Kanagawa, Japan

[73] Assignee: Fuji Photo Film Co., Ltd., Kanagawa, Japan

[21] Appl. No.: 714,418

[22] Filed: Mar. 21, 1985

[30] Foreign Application Priority Data

Mar. 23, 1984 [JP] Japan ..... 59-55685

[51] Int. Cl.[4] ..... G03C 1/06; G03C 5/24

[52] U.S. Cl. ..... 430/265; 430/268; 430/438; 430/441; 430/448; 430/949; 430/567

[58] Field of Search ..... 430/204, 268, 265, 949, 430/493, 438, 441, 448, 567

[56] References Cited

U.S. PATENT DOCUMENTS

| | | | |
|---|---|---|---|
| 3,776,731 | 12/1973 | Iwano et al. | 430/268 |
| 3,793,027 | 2/1974 | Okutsu et al. | 430/265 |
| 3,846,129 | 11/1974 | Kuh | 430/468 |
| 3,876,427 | 4/1975 | Okutsu et al. | 430/268 |
| 4,166,742 | 9/1979 | Mifune et al. | 430/949 |
| 4,269,929 | 5/1981 | Nothnagle | 430/265 |
| 4,416,980 | 11/1983 | Fujiwhara et al. | 430/949 |

*Primary Examiner*—Mary F. Downey

*Attorney, Agent, or Firm*—Sughrue, Mion, Zinn Macpeak & Seas

[57] ABSTRACT

A process for forming a high contrast negative image by developing an exposed substantial surface latent image type silver halide photographic light-sensitive material in the presence of hydrazines, which comprises using a developing solution having a pH value of 10.5 to 12.3 and containing at least (1) a developing agent, (2) 0.25 mol/l or more of sulfite, and (3) a compound represented by the following general formula (I):

(I)

wherein $R_1$, $R_2$, $R_3$, $R_4$ and $R_5$, which may be the same or different, each represents a hydrogen atom, a hydroxyl group, an alkyl group, an alkoxy group or a substituted alkyl group. According to the process, the development processing time required is shortened in the case of forming a high contrast negative image with a stable developing solution using hydrazines.

8 Claims, No Drawings

PROCESS FOR FORMING HIGH CONTRAST NEGATIVE IMAGE

FIELD OF THE INVENTION

The present invention relates to a process for forming an image with a silver halide photographic light-sensitive material and, particularly, to a process for forming a negative image having high contrast useful in graphic arts by processing with a stable developing solution for a short time.

BACKGROUND OF THE INVENTION

In the field of graphic arts, an image forming system showing photographic characteristics of high contrast (10 or more of gamma) is required for attaining good reproduction of a continuous gradation image formed by a halftone image or good reproduction of line drawings.

For such a purpose, hitherto, a special developing solution called lith-developing solution has been used. The lith-developing solution contains only hydroquinone as a developing agent, wherein free sulfite ion concentration is kept at a very low value by using, as a preservative, sulfite in a state of an adduct of formaldehyde so that infectious developability thereof is not damaged. Therefore, the lith-developing solution has a serious fault that it cannot be preserved over 3 days, because it is very easily oxidized by the air.

As a process for obtaining the photographic characteristics of superhard tone using a stable developing solution, there is a process using hydrazine derivatives described in U.S. Pat. Nos. 4,224,401, 4,168,977, 4,166,742, 4,311,781, 4,272,606, 4,221,857 and 4,243,739. According to this process, photographic characteristics of high contrast and high sensitivity are obtained and stability of the developing solution to oxidation by the air is remarkably improved as compared with the lith-developing solution, because sulfite of high concentration can be added to the developing solution. However, this process using hydrazines has a problem that it requires a comparatively long developing time for obtaining the desired photographic characteristics of high contrast and high sensitivity. For example, among the examples of the above-described U.S. patents, a developing time of 1 minute to 3 minutes is usually used, and there is a tendency to require a longer developing time with lowering of the pH value of the developing solution.

In the field of graphic arts, it is very important to solve the above-described problem, because stabilization of the developing solution and rapid processing have been greatly demanded in recent years.

In color diffusion transfer processes, a combination of an internal latent image type emulsion and hydrazines is used as one means of obtaining a direct positive image. However, this combination does not form a negative image having as high contrast as that attained in the present invention. U.S. Pat. No. 3,846,129 describes adding an aromatic alcohol dye booster to a p-phenylenediamine type viscous developing solution together with a competing developer in the color diffusion transfer process using the above-described combination of hydrazines and an internal latent image type emulsion. However, the aromatic alcohols used here are believed to have only the function of accelerating transfer of the formed dye and interaction between the alcohols and the hydrazines is not suggested at all.

SUMMARY OF THE INVENTION

An object of the present invention is to provide a process wherein the development processing time required is shortened in the case of forming a high contrast negative image with a stable developing solution using hydrazines.

The object of the present invention has been attained by developing an exposed substantial surface latent image type silver halide photographic light-sensitive material with a developing solution having a pH value of 10.5 to 12.3 and containing at least (1) a developing agent, (2) 0.25 mol/l or more of sulfite and (3) a compound represented by the following general formula (I) in the presence of hydrazines.

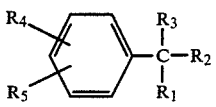

(I)

In the formula, $R_1$, $R_2$, $R_3$, $R_4$ and $R_5$, which may be the same or different, each represents a hydrogen atom, a hydroxyl group, an alkyl group (preferably, that having 4 or less carbon atoms, for example, a methyl group, an ethyl group, an n-propyl group, an isopropyl group or an n-butyl group, etc.), an alkoxy group (preferably that having 4 or less carbon atoms in the alkyl moiety, for example, a methoxy group or an ethoxy group, etc.) or a substituted alkyl group (preferably that having 4 or less carbon atoms in the alkyl moiety, for example, a hydroxymethyl group or a hydroxyethyl group, etc.).

DETAILED DESCRIPTION OF THE INVENTION

Of the compounds represented by general formula (I), those wherein any of $R_1$, $R_2$ and $R_3$ is a hydroxyl group are suitable. It is preferred that $R_1$, $R_2$ and $R_3$ each represents a hydrogen atom, a hydroxyl group, an alkyl group or a hydroxyalkyl group, and $R_4$ and $R_5$ each represents a hydrogen atom, an alkyl group or an alkoxy group.

Examples of compounds represented by general formula (I) include the following compounds, but the present invention is not restricted to them.

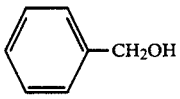

I-1

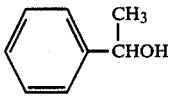

I-2

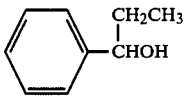

I-3

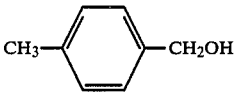

I-4

-continued

I-5

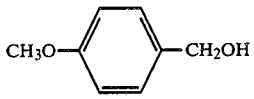

I-6

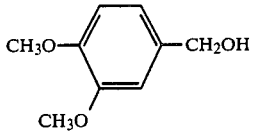

I-7

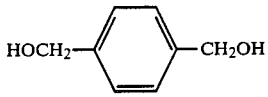

I-8

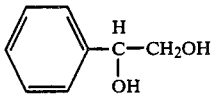

I-9

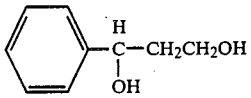

I-10

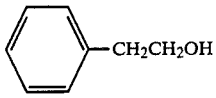

I-11

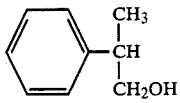

I-12

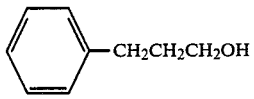

I-13

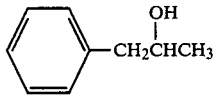

I-14

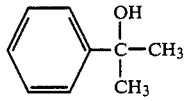

These compounds are known and are commercially available. Additionally, the compounds can be synthesized by known synthesis processes.

In the image forming process of the present invention, the compounds represented by the above-described general formula (I) show the effect of accelerating the function of hydrazines for sensitization and high contrast and also show the effect to shorten the time necessary for development, when the substantial surface latent image type silver halide photographic light-sensitive material is exposed to light and developed in the presence of hydrazines. As described above, hitherto, the lower the pH value of the developing solution is, the longer the time required for development. However, when the compounds represented by general formula (I) are used, it is possible to complete the processing within a short time with a developing solution having a comparatively low pH value. Thus, it is possible to meet the demand of promoting stabilization of the developing solution and carrying out rapid processing.

The compounds represented by general formula (I) are preferred to be used in an amount of 0.005 mol/l to 0.50 mol/l.

The developing agent used for the developing solution in the present invention is not particularly limited, but it preferably contains dihydroxybenzenes because good quality of halftone can be easily obtained. Combinations of dihydroxybenzenes and 1-phenyl-3-pyrazolidones are further preferable from the viewpoint of development capacity.

As dihydroxybenzene developing agents used in the present invention, there are hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., and hydroquinone is particularly preferred to use.

As 1-phenyl-3-pyrazolidone or derivatives thereof used as developing agents in the present invention, there are 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc.

The developing agents are preferred to be used generally in an amount of 0.05 mol/l to 0.8 mol/l. In the case of using combinations of dihydroxybenzenes and 1-phenyl-3-pyrazolidones, it is preferred that the former is used in an amount of 0.05 mol/l to 0.5 mol/l and the latter is used in an amount of 0.06 mol/l or less.

As sulfites used as preservatives in the present invention, there are sodium sulfite, potassium sulfite, lithium sulfite, ammonium sulfite, sodium bisulfite, potassium metabisulfite, formaldehyde-sodium bisulfite, etc. The sulfites are used in an amount of 0.25 mol/l or more, particularly 0.3 mol/l or more. However, the upper limit desirably is 1.2 mols/l, because addition of too large an amount causes pollution of the developing solution by precipitation.

The pH of the developing solution of the present invention is adjusted to a range of 10.5 to 12.3. As alkali agents used for adjusting the pH, conventional water-soluble inorganic alkali metal salts (for example, sodium hydroxide, sodium carbonate, potassium tertiary phosphate, etc.) can be used.

The developing solution according to the present invention is characterized by containing a developing agent, at least 0.25 mol/l of a sulfite preservative and a compound represented by the above-described general formula (I). Except for these components, the developing solution according to the present invention has the same composition as conventional silver halide photographic developing solutions. As additives used in addition to the above-described components, it may contain pH controlling agents or buffer agents such as boric acid, borax, sodium hydroxide, potassium hydroxide, sodium carbonate, potassium carbonate, sodium tertiary phosphate or potassium tertiary phosphate; development restrainers such as sodium bromide, potassium bromide or potassium iodide; organic solvents such as ethylene glycol, diethylene glycol, triethylene glycol, dimethylformamide, methyl cellosolve, hexylene glycol, ethanol or methanol; or antifogging agents or black pepper preventing agents, for example, mercapto compounds such as 1-phenyl-5-mercaptotetrazole or sodium 2-mercaptobenzimidazole-5-sulfonate, etc., indazole compounds such as 5-nitroindazole, etc., or benzotriazole compounds such as 5-methylbenzotriazole, etc. If necessary, it may contain toning agents, surfactants, defoaming agents, water softeners, hardeners, amino compounds described in Japanese Patent Application (OPI) No. 106244/81 (the term "OPI" as used herein refers to a "published unexamined Japanese patent application"), etc.

As a fixing solution, that having a composition conventionally used can be used. As fixing agents, not only thiosulfates and thiocyanates but also organic sulfur compounds which are known to have an effect as fixing agents can be used. The fixing solution may contain water-soluble aluminum salts as hardeners. Trivalent iron compounds can be used as oxidizing agents complexed with ethylenediaminetetraacetic acid.

The development processing temperature is usually selected between 18° C. and 50° C. and preferably between 25° C. and 43° C.

The process for development of the present invention is suitable for rapid processing in an automatic developing apparatus. As the automatic developing apparatus, any of a roller conveyer type, a belt conveyer type and others can be used. The processing time may be short, which is a total of 2 minutes or less, particularly 100 seconds or less, and a sufficient effect is shown by rapid processing that the time allotted to development is as low as 15 seconds to 60 seconds.

According to the process for development processing of the present invention, it becomes unecessary to carry out complicated control of the liquid, and constant photographic characteristics of superhard tone and high sensitivity can always be obtained by supplying the liquid according to the processing area on the light-sensitive material.

As hydrazines used in the image forming process of the present invention, there are hydrazine sulfate, hydrazine hydrochloride, etc., and preferably hydrazines described in U.S. Pat. Nos. 4,224,401, 4,243,739, 4,272,614, 4,385,108, 4,269,929 (hydrazines described as being suitable for adding to light-sensitive materials), 4,323,643, etc.

The hydrazines may be allowed to exist in the developing solution or may be added to an emulsion layer or an adjacent hydrophilic colloid layer thereof in the light-sensitive material. When the hydrazines are used in the developing solution, the amount is in the range of 5 mg to 5 g/l, particularly 10 mg to 1 g/l. When the hydrazines are added to the light-sensitive material, the amount is in the range of $10^{-6}$ mol to $5\times10^{-2}$ mol, particularly $10^{-5}$ mol to $2\times10^{-2}$ mol, per mol of silver halide.

In particularly preferred embodiments of the present invention, hydrazine derivatives represented by general formula (II) are added to an emulsion layer or an adjacent hydrophilic colloid layer thereof in the light-sensitive material.

$$R_6—NHNH—G—R_7 \qquad \text{(II)}$$

wherein $R_6$ represents an aliphatic group or an aromatic group, $R_7$ represents a hydrogen atom, a substituted or unsubstituted alkyl group, a substituted or unsubstituted aryl group, a substituted or unsubstituted alkoxy group, or a substituted or unsubstituted aryloxy group, and G represents a carbonyl group, a sulfonyl group, a sulfoxy group, a phosphoryl group or an N-substituted or unsubstituted imino group.

In general formula (II), the aliphatic group represented by $R_6$ is preferably that having 1 to 30 carbon atoms, particularly a straight chain, branched chain or cyclic alkyl group having 4 to 20 carbon atoms. The branched chain alkyl group may be cyclized so as to form a saturated heterocyclic ring containing one or more hetero atoms therein. The alkyl group may have various substituents such as aryl groups, alkoxy groups, sulfonamide groups, acylamino groups or combinations thereof.

In general formula (II), the aromatic group represented by $R_6$ is a monocyclic or bicyclic aryl group or an unsaturated heterocyclic group. Here, the unsaturated heterocyclic group may form a heteroaryl group by condensing with a monocyclic or bicyclic aryl group. The aromatic group represented by $R_6$ may have substituents, and has preferably 30 or less carbon atoms (including carbon atoms in substituents if such are present). Examples of preferred substituents include straight chain, branched chain or cyclic alkyl groups, alkoxy groups, substituted amino groups, acylamino groups, sulfonamide groups, thiourea groups, thioamide groups, groups having a carbon-nitrogen double bond (>C=N—), heterocyclic groups and combinations thereof. Details of these substituents are described in Japanese Patent Application (OPI) No. 129436/82, etc.

As $R_6$ in general formula (II), the substituted or unsubstituted aryl group is most preferred in the light of the object of the present invention.

In general formula (II), as the alkyl group represented by $R_7$, an alkyl group having 1 to 4 carbon atoms is preferred, which may have substituents such as a halogen atom, a cyano group, a carboxyl group, a sulfo group, an alkoxy group, a phenyl group, etc.

In general formula (II), the aryl group which may be substituted and represented by $R_7$ is a monocyclic or bicyclic aryl group, which includes, for example, a benzene ring. The aryl group may be substituted with, for example, a halogen atom, an alkyl group, a cyano group, a carboxyl group or a sulfo group, etc.

In general formula (II), the alkoxy group which may be substituted and represented by $R_7$ is that having 1 to 8 carbon atoms which may be substituted with a halogen atom, an aryl group, etc.

In general formula (II), the aryloxy group which may be substituted and represented by $R_7$ is preferred to be a monocyclic group. As the substituents, there are halogen atoms, etc.

Preferred examples of the groups represented by $R_7$ in the case that G is a carbonyl group include a hydrogen atom, a methyl group, a methoxy group, an ethoxy group and a substituted or unsubstituted phenyl group. Particularly, a hydrogen atom is preferred.

In the case that G is a sulfonyl group, preferred examples of $R_7$ include a methyl group, an ethyl group, a phenyl group and a 4-methylphenyl group. Particularly, a methyl group is preferred.

In the case that G is a phosphoryl group, preferred examples of $R_7$ include a methoxy group, an ethoxy group, a butoxy group, a phenoxy group and a phenyl group. Particularly, a phenoxy group is preferred.

In the case that G is a sulfoxy group, preferred examples of $R_7$ include a cyanobenzyl group, a methylthiobenzyl group, etc. In the case that G is an N-substituted or unsubstituted imino grouup, examples of preferred $R_7$ include a methyl group, an ethyl group and a substituted or unsubstituted phenyl group.

$R_6$ or $R_7$ in general formula (II) may be the group wherein a ballast group conventionally used in immobile photographic additives such as couplers, etc., is incorporated therein. The ballast group is the group having 8 or more carbon atoms, which is comparatively inactive to photographic properties. For example, it can be selected from an alkyl group, an alkoxy group, a phenyl group, an alkylphenyl group, a phenoxy group and an alkylphenoxy group, etc.

$R_6$ or $R_7$ in general formula (II) may be the group wherein a group for accelerating adsorption in the surface of the silver halide grains is incorporated therein. As such adsorptive groups, there are groups described in U.S. Pat. No. 4,385,108 such as a thiourea group, a heterocyclic thioamide group, a mercaptoheterocyclic group, a triazole group, etc.

As G in general formula (II), a carbonyl group is most preferred.

Examples of the compounds represented by general formula (II) are described in the following. However, the present invention is not limited to these compounds.

1 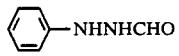

2 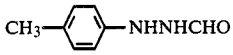

3 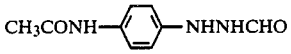

4 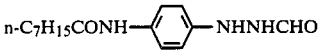

5 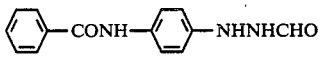

6 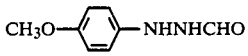

7 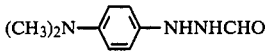

8 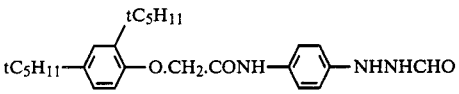

9 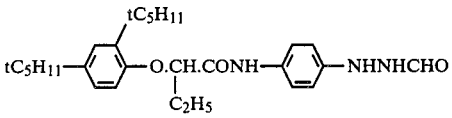

10 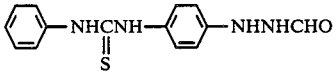

11 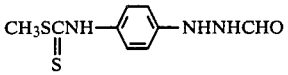

-continued

12 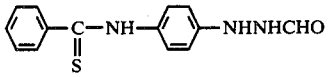

13 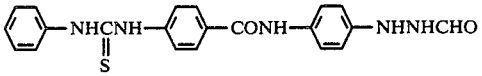

14 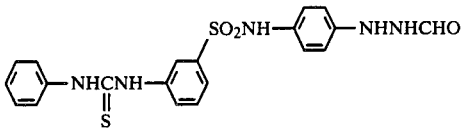

15 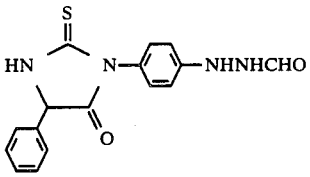

16 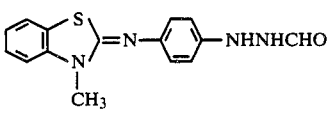

17 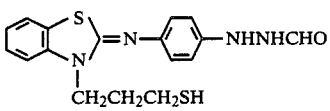

18 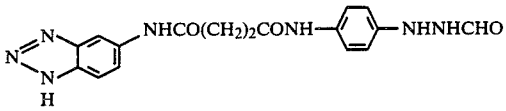

19 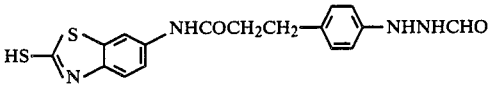

20 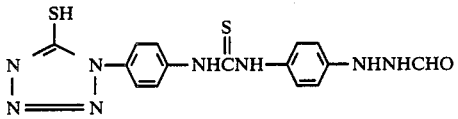

21 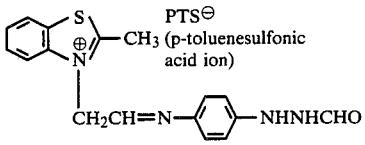

22 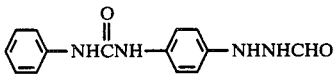

23 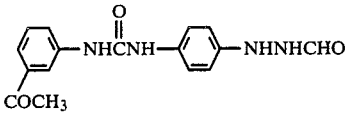

24 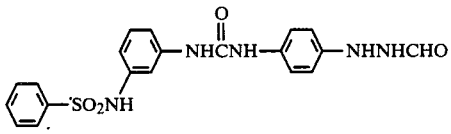

-continued
25 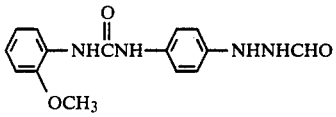
26 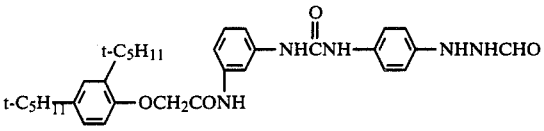
27 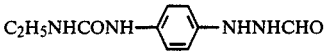
28 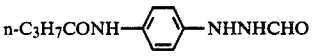
29 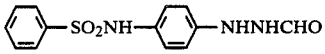
30 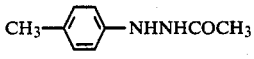
31 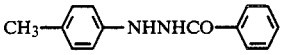
32 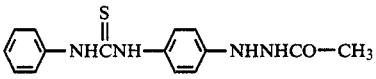
33 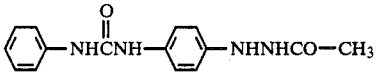
34 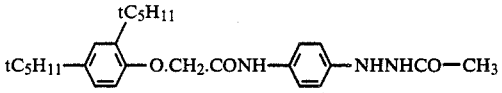
35 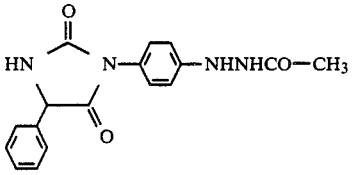
36 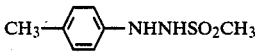
37 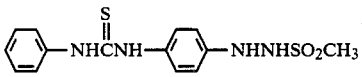
38 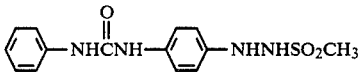
39 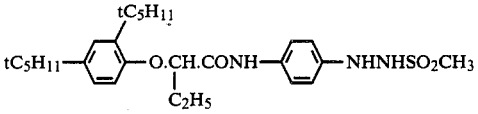
-continued
40 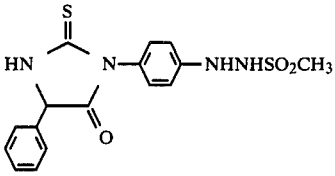
41 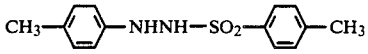
42 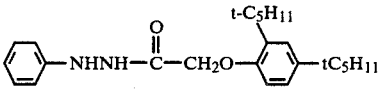
43 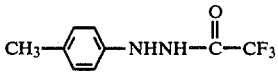
44 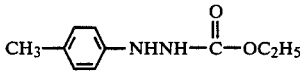
45 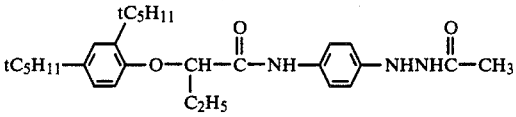
46 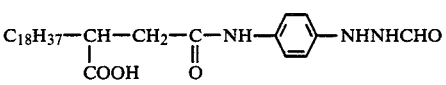
47 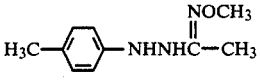
48 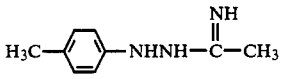
49 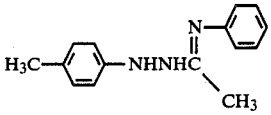
50 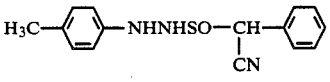
51 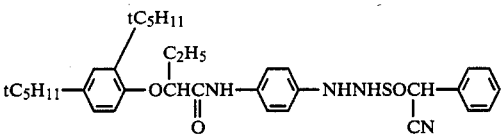
52 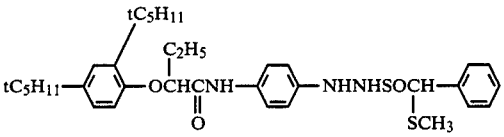
53 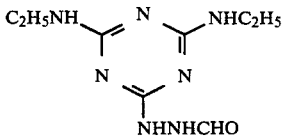

-continued

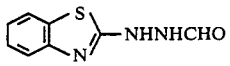

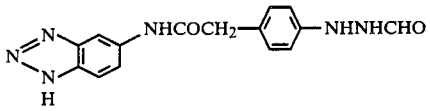

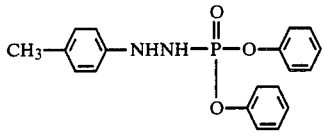

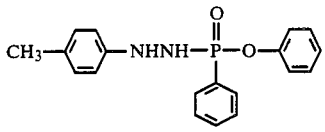

$n\text{-}C_{12}H_{25}$—NHNHCHO

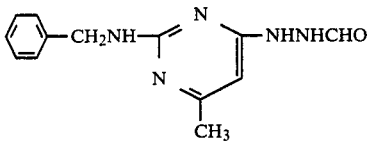

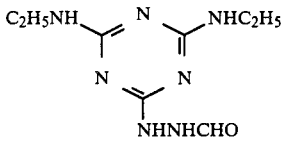

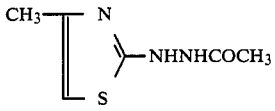

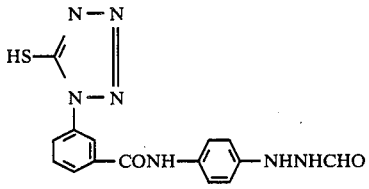

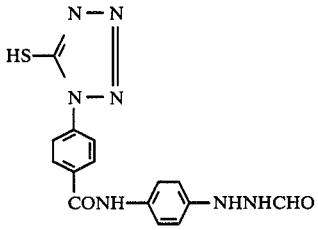

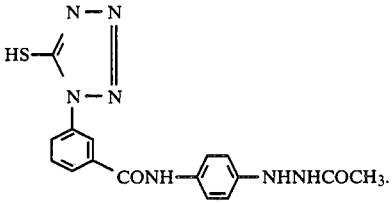

In the present invention, in the case of incorporating the compound represented by general formula (II) in the photographic light-sensitive material, it is dissolved in an organic solvent miscible with water, such as alcohols (for example, methanol or ethanol), esters (for example, ethyl acetate), ketones (for example, acetone), etc., to make a solution, or it is added to a hydrophilic colloid solution as an aqueous solution in the case of being water-soluble.

In the case of adding to a photographic emulsion, the addition thereof may be carried out at an arbitrary time between beginning of chemical ripening and application of the emulsion, but the addition is preferably carried out after the conclusion of chemical ripening.

In the following, silver halide photographic light-sensitive materials to which the image forming process of the present invention is applied are illustrated.

The silver halide light-sensitive materials used in the present invention have at least one emulsion layer composed of a substantial surface latent image type silver halide emulsion.

Here, the term "substantial surface latent image type silver halide emulsion" means a silver halide emulsion of the type wherein a latent image is formed mainly on the surface of the grains, which has properties opposed to those of an internal latent image type silver halide emulsion. In greater detail, it is an emulsion defined by a test described in U.S. Pat. No. 4,224,401.

Halide compositions of silver halide emulsions used are not particularly limited, and any of silver chloride, silver chlorobromide, silver iodobromide, silver iodobromochloride, etc., may be used.

A silver iodide content is preferred to be 5% by mol or less, preferably 3% by mol or less.

Silver halide grains in the photographic emulsions used in the present invention may have a comparatively wide distribution of particle size, but those having a narrow distribution of particle size are preferred. It is particularly preferred that 90% of silver halide grains based on the whole grains with respect to weight or number has a particle size within ±40% of the average particle size. (Such an emulsion is generally called a monodisperse emulsion.)

The silver halide grains used in the present invention are preferred to be finer grains (for example, about 0.7μ or less), particularly, those having a size of about 0.4μ are preferred.

The silver halide grains in the photographic emulsions may be those having a regular crystal form such as a cube or an octahedron, or those having an irregular crystal form such as a sphere or plate, etc., or may be those having a composite crystal form thereof. They may be composed of a mixture of grains having different crystal forms.

The inner part and the surface of the silver halide grains may be composed of a uniform phase or may have each a different phase.

Two or more of silver halide emulsions prepared respectively may be used as a mixture.

In the silver halide emulsions used in the present invention, formation or physical ripening of silver halide grains may be carried out in the presence of cadmium salts, zinc salts, lead salts, thallium salts, iridium salts or complex salts thereof, rhodium salts or complex salts thereof, or iron salts or complex salts thereof, etc.

Use of rhodium salts or complex salts thereof is particularly preferred, because they have the effect of further improving aptitude of rapid processing. Typical rhodium salts are rhodium chloride, rhodium trichloride and rhodium ammonium chloride, etc., and complex salts thereof can be used as well. Addition of the rhodium salts can be carried out at any time, if it is before conclusion of the first ripening in production of the emulsion. However, it is particularly preferred to add them during formation of grains, and the amount of rhodium added is in the range of $1\times10^{-8}$ to $8\times10^{-6}$ mol, preferably $1\times10^{-7}$ mol to $5\times10^{-6}$ mol, per mol of silver.

When the rhodium salts are added to silver halide emulsions, reduction of a sensitivity is caused simultaneously with giving hard tone. However, the emulsions of the present invention are characterized in that a sensitivity is recovered by the compounds represented by the above-described general formula (II) and, at the same time, remarkable hard tone is obtained.

As a binder or a protective colloid in the photographic emulsions, gelatin is advantageously used, but other natural or synthetic hydrophilic colloids can be used as well.

As gelatin, acid-processed gelatin may be used as well as lime-processed gelatin. Hydrolyzed products of gelatin and enzyme decomposed products of gelatin can be used, too.

Water-soluble salts are usually removed from the emulsions after formation of precipitates or after physical ripening. As a means for such a purpose, a noodle water wash process well known hitherto wherein gelatin is gelatinized may be used, and a flocculation process utilizing inorganic salts composed of a polyvalent anion, such as sodium sulfate, anionic surface active agents, anionic polymers (for example, polystyrenesulfonic acid) or gelatin derivatives (for example, aliphatic acylated gelatin, aromatic acylated gelatin or aromatic carbamoylated gelatin, etc.) may be used. The step of removing soluble salts may be omitted.

The silver halide emulsions used in the process of the present invention may not be chemically sensitized, but they are preferred to be chemically sensitized. As chemical sensitization of silver halide emulsions, sulfur sensitization, reduction sensitization and noble metal sensitization are known, and any of them may be used alone or in combination. They have been described in H. Frieser, *Die Grundlagen der Photographischen Prozesse mit Silberhalogeniden* (Akademische Verlagsgesellschaft, 1968).

In the noble metal sensitization, gold sensitization is a typical process, wherein gold compounds and, mainly, gold complex salts are used. Complex salts of noble metals other than gold, such as platinum, palladium, iridium, etc., can be, of course, included. Examples of them have been described in U.S. Pat. No. 2,448,060 and British Pat. No. 618,061, etc.

As sulfur sensitizers, not only sulfur compounds contained in gelatin, but also various sulfur compounds, for example, thiosulfates, thioureas, thiazoles, rhodanines, etc., can be used. Examples of them are described in U.S. Pat. Nos. 1,574,944, 2,278,947, 2,410,689, 2,728,668, 3,501,313 and 3,656,955.

As a reduction sensitizer, stannous salts, amines, formamidinesulfinic acid, silane compound, etc., can be used. Examples of them have been described in U.S. Pat. Nos. 2,487,850, 2,518,698, 2,983,609, 2,983,610 and 2,694,637.

The light-sensitive materials of the present invention can contain various compounds for the purpose of preventing fog in the step of producing the light-sensitive material, during preservation or during photographic processing thereof or stabilizing photographic performances. Namely, it is possible to add many compounds known as antifoggants or stabilizers such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzothiazoles, nitrobenzotriazoles, mercaptotetrazoles (particularly 1-phenyl-5-mercaptotetrazole), etc.; mercaptopyrimidines; mercaptotriazines; thioketo compounds such as oxazolinethione; azaindenes, for example, triazaindenes, tetraazaindenes (particularly 4-hydroxy substituted (1,3,3a,7)tetraazaindenes), pentaazaindenes, etc.; benzenethiosulfonic acid, benzenesulfinic acid, benzenesulfonic acid amide, etc. Of these, benzotriazoles (for example, 5-methylbenzotriazole) and nitroimidazoles (for example, 5-nitroindazole) are particularly suitable. These compounds may be incorporated in processing solutions.

In the light-sensitive materials used in the present invention, it is possible to incorporate sensitizing dyes described in Japanese Patent Application (OPI) No. 52050/80, pages 45–53 (for example, cyanine dyes, merocyanine dyes, etc., which may be used alone or in combination), supersensitizers (for example, aminostilbene compounds, aromatic organic acid formaldehyde condensates, cadmium salts, azaindene compounds, etc.), water-soluble dyes (for the purpose of filter or preventing irradiation, for example, oxonol dyes, hemioxonol dyes, merocyanine dyes, etc.), hardeners (for example, chromium salts, aldehyde salts, N-methylol compounds, dioxane derivatives, active vinyl compounds, active halogen compounds, etc.), surface active agents (for example, known various nonionic, anionic, cationic and ampholytic surface active agents, polyalkylene described in Japanese Patent Application (OPI) No. 37732/79 are particularly useful), and the like.

Polyalkylene oxides or derivatives thereof suitably used in the present invention are those having a molecular weight of at least 600. These polyalkylene oxides or derivatives thereof may be incorporated in the silver halide light-sensitive material or may be incorporated in the developing solution.

Polyalkylene oxide compounds used in the present invention include condensation products of polyalkylene oxide composed of at least 10 units of alkylene oxide having 2 to 4 carbon atoms, for example, ethylene oxide, propylene-1,2-oxide, butylene-1,2-oxide, etc., and preferably ethylene oxide, and a compound having at least one active hydrogen atom such as water, aliphatic alcohol, aromatic alcohol, aliphatic acid, organic amine or hexitol derivative, etc., or block copolymers of two or more polyalkylene oxides.

Namely, as the polyalkylene oxide compounds, it is possible to use, for example, polyalkylene glycols,
polyalkylene glycol alkyl ethers,
polyalkylene glycol aryl ethers,
polyalkylene glycol alkylaryl ethers,
polyalkylene glycol esters,
polyalkylene glycol aliphatic acid amides,
polyalkylene glycol amines,
polyalkylene glycol block copolymers,
polyalkylene glycol graft polymers, etc.

One polyalkylene oxide chain is not always contained in the molecule, and two or more thereof may be contained in the molecule. In such a case, each polyalkylene oxide chain may be composed of 10 or less alkylene oxide units, but it is necessary that the molecule contain a total of at least 10 alkylene oxide units. In the case of having two or more polyalkylene oxide chains, each of them may be composed of different alkylene oxide units, for example, ethylene oxide and propylene oxide. The polyalkylene oxide compounds capable of use in the present invention are, preferably, those containing 14 to 100 alkylene oxide units.

The light-sensitive materials used in the present invention can contain dispersions of water-insoluble or poorly soluble synthetic polymers for the purpose of improving dimensional stability, etc. For example, it is possible to use polymers composed of one or more of alkyl acrylates (methacrylates), alkoxyalkyl acrylates (methacrylates), glycidyl acrylates (methacrylates), acrylamide (methacrylamide), vinyl esters (for example, vinyl acetate), acrylonitrile, olefins and styrene, etc., and polymers composed of a combination of the above-described monomer components and acrylic acid, methacrylic acid, $\alpha,\beta$-unsaturated dicarboxylic acid, hydroxyalkyl acrylates (methacrylates), sulfoalkyl acrylates (methacrylates), styrenesulfonic acid, and the like. For example, it is possible to use those described in U.S. Pat. Nos. 2,376,005, 2,739,137, 2,853,457, 3,062,674, 3,411,911, 3,488,708, 3,525,620, 3,607,290, 3,635,715 and 3,645,740, and British Pat. Nos. 1,186,699 and 1,307,373. Since the hard tone emulsions of the present invention are suitable for reproducing line drawings, it is preferred to contain the above-described polymer dispersions, because dimensional stability is important for such use.

In the following, the present invention is illustrated in greater detail with reference to a non-limiting example. Unless otherwise specified, all ratios, percents, etc., are by weight.

EXAMPLE

A silver chlorobromide emulsion (grain size: about 0.3$\mu$) containing rhodium was prepared. After soluble salts were removed from the emulsion according to the conventional process, it was chemically ripened by adding sodium thiosulfate and potassium chloroaurate. The resulting emulsion contained 70% by mol of silver chloride and 30% by mol of silver bromide and $5\times10^{-6}$ mol of rhodium/mol of silver. To the emulsion, 1-formyl{2-4-[2-(2,4-di-t-pentylphenoxy)-butyramido]phenyl}-hydrazide (Compound 9, which is a compound represented by general formula (II)) was added in an amount of $1\times10^{-3}$ mol per mol of silver. After adding 3-ethyl-5-[2-(3-ethyl-2(3H)-thiazolinylidene)ethylidene]rhodanine as a sensitizing dye, 5-methylbenzotriazole, 4-hydroxy-6-methyl-1,3,3a,7-tetraazaindene, a polyethyl acrylate dispersion, and sodium salt of 2-hydroxy-4,6-dichloro-1,3,5-triazine, the emulsion was applied to a cellulose triacetate film so as to result in a silver amount of 4 g/m$^2$.

After this film was exposed to light through an exposure wedge for sensitometry using a 150 line magenta contact screen, it was developed at 38° C. for 20 seconds with a developing solution having the following composition, and subjected to fixation, water wash and drying. For the processing, an automatic developing apparatus: FG600F produced by Fuji Photo Film Co., Ltd. was used.

As the developing solution, those having the following compositions A, B, C and D were used.

Developing Solution A

| | |
|---|---|
| Hydroquinone | 35.0 g |
| 4-Hydroxymethyl-4-methyl-1-phenyl-3-pyrazolidone | 0.3 g |
| Sodium Sulfite | 75.0 g |
| Potassium Secondary Phosphate | 60.0 g |
| Disodium Ethylenediaminetetraacetate | 1.0 g |
| Potassium Bromide | 3.5 g |
| 5-Methylbenzotriazole | 0.3 g |
| Water to make | 1 liter |

pH was adjusted to 11.3 with potassium hydroxide.

Developing Solution B

That which was prepared by blending a dispersion previously prepared by adding 5.0 g/l (0.046 mol/l) of the exemplified Compound (I-1) represented by general formula (I) to an aqueous solution containing 10 g of diethylene glycol, with the Developing Solution A, and adjusting the pH to 11.3.

Developing Solution C

That which was prepared by blending a dispersion previously prepared by adding 5.6 g/l (0.046 mol/l) of the exemplified Compound (I-2) represented by general formula (I) to an aqueous solution containing 10 g of diethylene glycol, with the Developing Solution A, and adjusting the pH to 11.3.

Developing Solution D

That which was prepared by blending a dispersion previously prepared by adding 7.8 g/l (0.046 mol/l) of the exemplified Compound (I-6) represented by general formula (I) to an aqueous solution containing 10 g of diethylene glycol, with the Developing Solution A, and adjusting the pH to 11.3.

Results are shown in Table 1. In Table 1, the photographic sensitivity was presented as a relative value of a reciprocal of an exposure amount necessary for obtaining a density of 1.5, wherein the value in the case of using Developing Solution A was 100. $\gamma$ was presented as tan $\theta$ obtained from logarithms of exposure amount obtaining for densities of 0.3 and 3.0 with respect to the values of the densities. The quality of halftone was visually evaluated in five grades, and "5" means the best quality of halftone and "1" means the worst quality of halftone. The quality of halftone "5" or "4" means that the product can be practically used as an original halftone plate for plate making, "3" means that it can be barely used practically though the quality is inferior, and "2" or "1" means that practical use is impossible.

TABLE 1

| | Sensitivity | Gamma | Quality of Halftone |
|---|---|---|---|
| Developing Solution A (Comparison) | 100 | 5.0 | 1 |
| Developing Solution B (This Invention) | 250 | 12.5 | 4 |
| Developing Solution C (This Invention) | 300 | 16.0 | 5 |
| Developing Solution D (This Invention) | 300 | 16.0 | 5 |

It is understood from Table 1 that, when developing solutions containing the compounds represented by general formula (I) are used, a negative image having photographic characteristics of sufficiently high sensitivity and high contrast can be obtained by developing at 38° C. for 20 seconds (pH: 11.5). When Developing Solution A was used, a development time of a little over 5 minutes was required for obtaining the same degree of sensitivity and contrast as in the present invention.

While the invention has been described in detail and with reference to specific embodiments thereof, it will be apparent to one skilled in the art that various changes and modifications can be made therein without departing from the spirit and scope thereof.

What is claimed is:

1. A process for forming a high contrast negative image by developing an image-wise exposed substantial surface latent image type silver halide photographic light-sensitive material in the presence of hydrazines, which comprises using a developing solution having a pH value of 10.5 to 12.3 and containing at least (1) a developing agent which contains dihydroxylbenzenes, (2) 0.25 mol/l or more of sulfite, and (3) a compound represented by general formula (I):

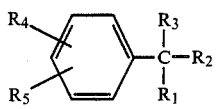

(I)

wherein $R_1$, $R_2$, $R_3$, $R_4$ and $R_5$, which may be the same or different, each represents a hydrogen atom, a hydroxyl group, an alkyl group, an alkoxy group or a substituted alkyl group.

2. A process according to claim 1, wherein the developing solution contains the compound represented by general formula (I) in an amount of 0.005 mol/l to 0.50 mol/l.

3. A process according to claim 1, wherein the alkyl group of general formula (I) has 4 or less carbon atoms; the alkoxy group of general formula (I) has 4 or less carbon atoms in the alkyl moiety; and the substituted alkyl group has 4 or less carbon atoms in the alkyl moiety.

4. A process according to claim 1, wherein the hydrazines are compounds represented by general formula (II)

$$R_6—NHNH—G—R_7 \quad \text{(II)}$$

wherein $R_6$ represents an aliphatic group or an aromatic group, $R_7$ represents a hydrogen atom, a substituted or unsubstituted alkyl group, a substituted or unsubstituted aryl group, a substituted or unsubstituted alkoxy group, or a substituted or unsubstituted aryloxy group, and G represents a carbonyl group, a sulfonyl group, a sulfoxy group, a phosphoryl group or an N-substituted or unsubstituted imino group.

5. A process according to claim 1, wherein the hydrazines are included in the developing solution in an amount of 5 mg/l to 5 g/l.

6. A process according to claim 1, wherein the hydrazines are included in an emulsion layer or an adjacent hydrophilic colloid layer of the silver halide photographic light-sensitive material in an amount of $10^{-6}$ mol to $5\times10^{-2}$ mol per mol of silver halide.

7. A process according to claim 1, wherein the developing agent contains combinations of dihydroxybenzenes and 1-phenyl-3-pyrazolidones.

8. A process according to claim 1, wherein the developing agent is used in an amount of 0.05 mol/l to 0.8 mol/l.

* * * * *